US007434410B2

(12) United States Patent
Ford

(10) Patent No.: US 7,434,410 B2
(45) Date of Patent: Oct. 14, 2008

(54) REVERSIBLE ICE CHEST

(76) Inventor: Robert G. Ford, 5875 Silver Creek Rd., Azle, TX (US) 76020

( * ) Notice: Subject to any disclaimer, the term of this patent is extended or adjusted under 35 U.S.C. 154(b) by 317 days.

(21) Appl. No.: 11/328,944

(22) Filed: Jan. 10, 2006

(65) Prior Publication Data

US 2007/0157635 A1 Jul. 12, 2007

(51) Int. Cl.
*F25D 25/00* (2006.01)

(52) U.S. Cl. ..... 62/62; 62/371

(58) Field of Classification Search ..... 62/371, 62/457.7, 62; 220/592.03
See application file for complete search history.

(56) References Cited

U.S. PATENT DOCUMENTS 2,680,535 A 6/1954 Thon ..... 220/32
3,061,136 A 10/1962 Stergart ..... 220/20
3,423,869 A 1/1969 Duerst ..... 43/55
3,578,199 A 5/1971 Duncan ..... 220/31
5,481,823 A 1/1996 Hoover et al. ..... 43/55
6,540,084 B2 4/2003 Silvers ..... 206/581
6,574,983 B2 * 6/2003 Smith et al. ..... 62/372
7,147,125 B1 * 12/2006 Slovak et al. ..... 220/592.2

* cited by examiner

*Primary Examiner*—Melvin Jones
(74) *Attorney, Agent, or Firm*—Charles D. Gunter, jr.

(57) ABSTRACT

A reversible ice chest is shown having oppositely arranged, hinged lids. The lids allow the ice chest to be open and filled from either of two opposite directions. This allows a user to, for example, place drinks to be cooled on top of ice in a half filled chest. The chest would then be turned upside down, thereby covering the drinks with ice. The drinks could be accessed through the lid which is now facing up toward the user.

11 Claims, 2 Drawing Sheets

REVERSIBLE ICE CHEST

BACKGROUND OF THE INVENTION

A. Field of the Invention:

The present invention relates to the design of an ice chest or cooler which has oppositely arranged lids on the bottom and top portions thereof to allow the chest to be reversed or flipped in use.

B. Description of the Prior Art

There are a large number of prior art patents on various ice chest and cooler designs. There are also various packing designs in the prior art which feature oppositely arranged lids. For example, U.S. Pat. No. 2,680,535, shows an improved latch mechanism for a double compartmented box which prevents the simultaneous opening of both sides of the box, thereby preventing the accidental spilling of the contents of one side while the other is being used. The box in question does not appear to be used as an ice chest, however.

U.S. Pat. No. 3,061,136, shows a compartmented container for holding small items such as paper clips, stamps and the like, which could be flipped or reversed in use. However, the primary purpose of the container is to allow a convenient display of items in a store. The trays or compartments are relatively shallow and would not conveniently hold iced beverages or the like.

U.S. Pat. No. 3,578,199, shows a portable insulated carrier for cylindrical drink containers, such as soft drinks. Because of its reversible nature, it allows a last in, first out type of operation in use. However, because of its cylindrical nature, the device shown in the '199 reference allows only a single soft drink can to be added or dispensed at one time.

U.S. Pat. No. 3,423,869, shows a bait container which features oppositely arranged lids. The design is, in effect, an upside down worm can which allows a means for getting the worms to the upper part of the can or container when the fishermen desires to reach for a worm by simply reversing the can orientation. The can is not used as a cooler or ice chest and, in fact, features air openings which would facilitate heat transfer though the material of the container.

U.S. Pat. No. 5,481,823, shows a more complicated worm container which again features oppositely arranged removable lids. Again, the device is not used as a cooler or ice chest.

U.S. Pat. No. 6,540,084, shows a reversible lid container for holding wet baby diapers. Although the container has oppositely arranged lids, the central compartment is partitioned in such a way that it could not be used to load ice, drinks, or the like from either side of the partition.

Despite the above advances in the art, a need exists for an improved ice chest or cooler design which would allow the cooler to be flipped or reversed in use.

A need exists for such a design which would not require extensive changes to the manufacturing process or tooling for manufacturing conventional ice chests.

A need exist for such a design which would be simple in design and economical to manufacture.

SUMMARY OF THE INVENTION

Accordingly, it is an object of the invention to provide an improved ice chest or cooler which has oppositely arranged lids on the bottom and top portions thereof to allow the chest to be "reversed" or flipped in use. Because the ice chest body can be reversed or flipped in position, it is easier to cover items such as soft drink cans with ice. For example, if the body of the ice chest is half full of ice, a user would cover the exposed ice with drink cans. The lid would be closed and the ice chest would then be flipped upside down. The oppositely arranged lid could then be opened to allow easy access to the covered cans.

The improved ice chest of the invention includes a thermally insulated body having an exterior and an initially open interior which defines a top opening and a bottom opening for the body. The chest has a primary lid which is movable between an open and a closed position with respect to a selected one of the top and bottom openings. A latch is provided for holding the primary lid in the closed position. A secondary lid is movable between an open position and a closed position with respect to the other respective one of the top and bottom openings. The secondary lid also has an additional latch for holding the secondary lid in the closed position. A pair of oppositely arranged carrying handles are located on the exterior of the body, each carrying handle being slidably positionable between either of two carrying positions, depending upon whether the primary or the secondary lid is oriented in an upright position.

In one embodiment, the ice chest exterior is polygonally shaped being comprised of two pairs of opposing sides, and wherein a carrying handle is located on either of two of a selected pair of opposing sides of the ice chest. Each handle is preferably made up of a longitudinal bracket and a clasp which is free to slide upwardly and downwardly within the bracket. A drain fitting can be located on each of two vertically displaced locations on a selected sidewall or sidewalls of the chest so that one drain fitting is always conveniently located for draining the contents of the chest. The primary and secondary lids can conveniently be hingedly connected to the ice chest body proximate the top and bottom openings, respectively, thereof. Preferably, the secondary lid, which is oriented downwardly for carrying, is formed of a relatively heavier duty construction than the primary lid. Each of the primary and secondary lids has an associated circumferential seal or seal region which forms sealing contact between the lid and the ice chest body when the respective lid is moved to the closed position. The secondary lid seal is preferably of more robust construction than the primary lid seal since again, it will normally be oriented downwardly and carry the majority of the weight of the contents of the ice chest. In the preferred embodiment, the exterior of the ice chest is provided with marking indicia which indicates the current orientation of the primary and secondary lids.

The reversible ice chest is used by first partially filling the interior of the ice chest body with ice or other cooling media. The items to be cooled are then placed on top of the ice in the interior of the chest. The orientation of the ice chest body is then reversed so that the lid which was previously oriented upward is now oriented downward and the ice in the chest interior is now covering the items to be cooled. The items being cooled can be accessed by opening the now upwardly oriented lid.

The user of the chest can also choose to add additional items to be cooled to the interior of the ice chest. In that case, the orientation of the ice chest is then reversed so that the new items are covered with ice. The items being cooled can then be accessed through the opposite lid of the ice chest.

Additional objects, features and advantages will be apparent in the written description which follows.

DETAILED DESCRIPTION OF THE INVENTION

Figure 1:
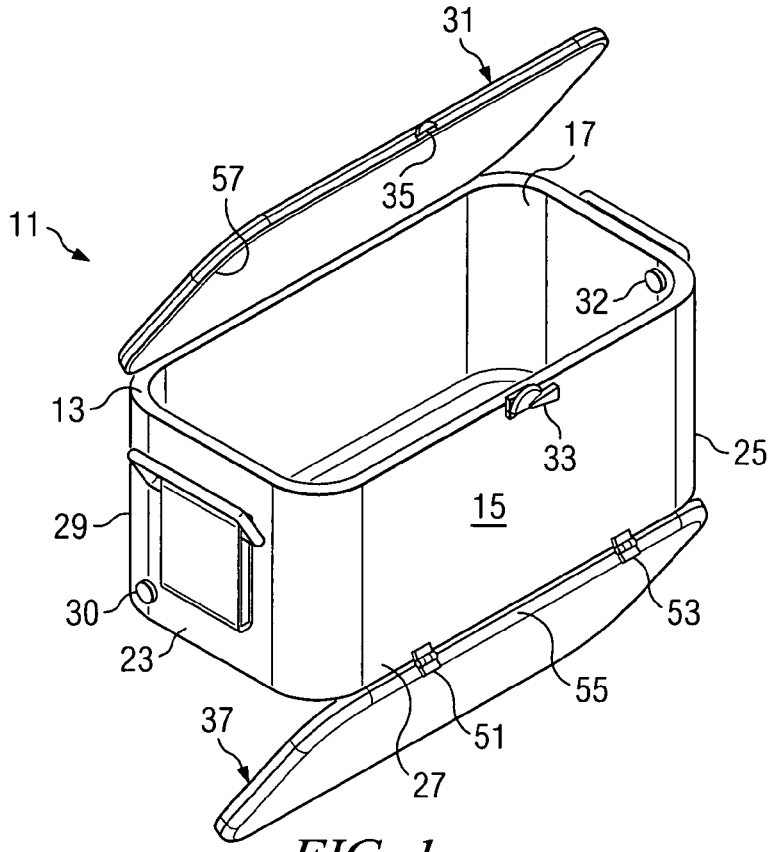
FIG. 1 is a perspective view of the improved ice chest of the invention showing the oppositely arranged, reversible lids in the open position and showing one of the reversible handles thereof.
Figure 2:
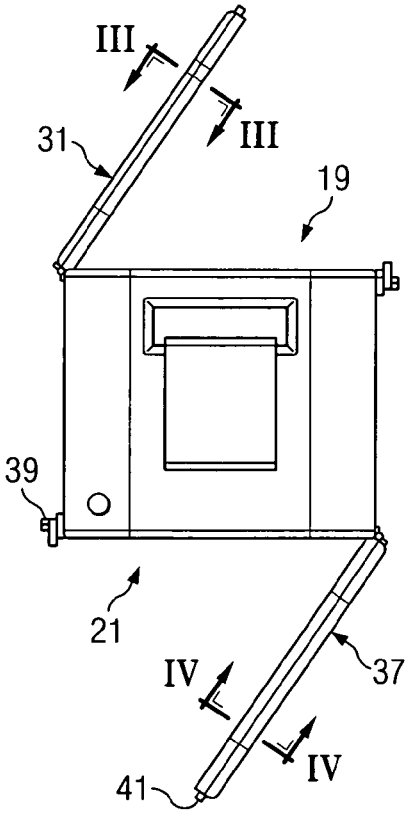
FIG. 2 is a side view of the improved ice chest of FIG. 1 with the lids in the partly open position.

Turning now to FIG. 1, there is shown a reversible ice chest of the invention designated generally as 11. The ice chest includes a thermally insulated body 13 having an exterior 15 and an initially open interior 17 which define a top opening 19 and bottom opening 21 (FIG. 2) for the body. The particular ice chest 11 illustrated in FIG. 1 is intended to be exemplary of the invention. However, as will be apparent from the discussion which follows, the ice chest could take a number of different shapes, sizes and configurations. In any event, the body 13 will be thermally insulated in order to maintain the chest interior temperature relatively constant when a cooling medium, such as ice, is placed within the chest interior 17.

In the embodiment of FIG. 1, the ice chest 11 is polygonally (rectangularly) shaped being comprised of two pairs of opposing sides 23, 25 and 27, 29, respectively. As can be seen in FIG. 1, a primary lid 31 is movable between an open position (shown in FIG. 1) and a closed position (shown in FIG. 5) with respect to a selected one of the top and bottom openings, 19, 21, respectively. A conventional latch and clasp 33, 35 are provided for holding the primary lid 31 in the closed position.

A secondary lid 37 is similarly movable between an open position (shown in FIG. 1) and a closed position with respect to the other respective one of the top and bottom openings, in this case, bottom opening 21. An additional latch and clasp 39, 41 (FIG. 2) are provided for holding the secondary lid 37 in the closed position.

Figure 6:
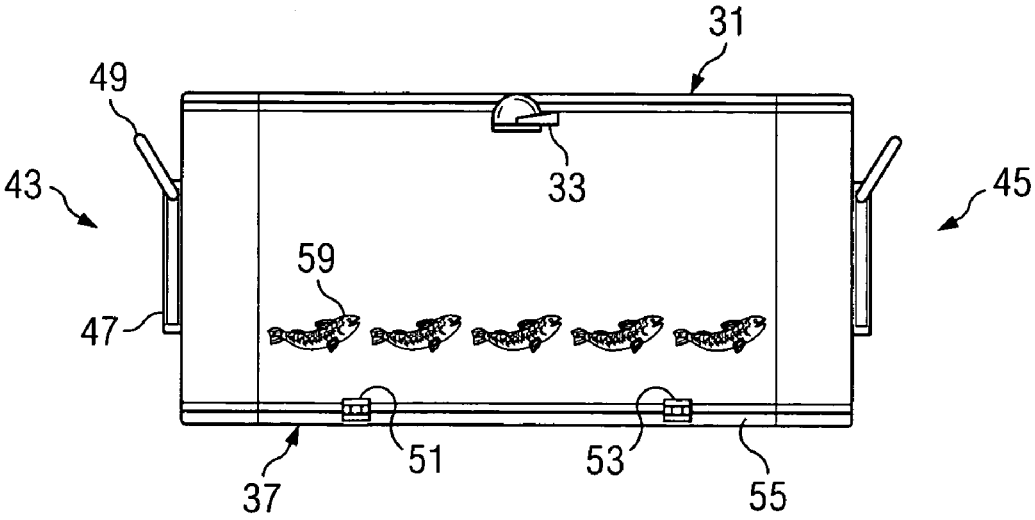
FIG. 6 is a front elevational view of the ice chest of the invention showing the marking indicia thereon.

As shown in FIG. 6, a pair of oppositely arranged carrying handles 43, 45 are located on the exterior 15 of the ice chest body 30. Each carrying handle 43, 45 is slidably positionable between either of two carrying positions, depending upon whether the primary or secondary lid 31, 37 is oriented in the upright position (generally shown in FIG. 6). Preferably, each handle assembly 43, 35 is comprised of a longitudinal bracket 47 and a clasp 49 which is free to slide upwardly and downwardly within the bracket. Other reversible handle arrangements may also be apparent to those skilled in the art.

As can be seen in FIG. 1, a drain fitting 30, 32 can be located on each of two vertically displaced locations on a selected sidewall or sidewalls 23, 25 of the chest so that one drain fitting is always conveniently located for draining the contents of the chest. In the embodiment of the invention illustrated in FIG. 1, the drain fittings 30, 32 are on the opposing sidewalls 23, 25. However, the fittings could, as easily, be located in the same sidewall, e.g., sidewall 23, at spaced vertical locations or could be placed in the lids 31, 37, themselves.

Figure 3:
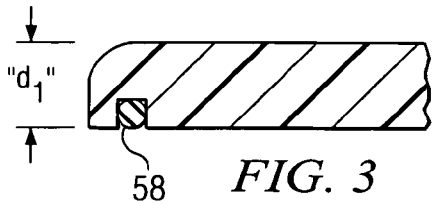
FIG. 3 is a partial sectional view of the primary lid of the ice chest, taken along lines III-III in FIG. 2.
Figure 4:
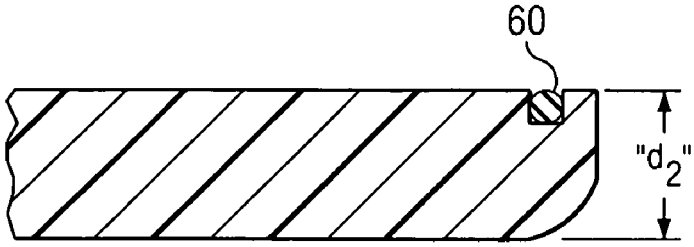
FIG. 4 is a partial sectional view of the secondary lid taken along lines IV-IV in FIG. 2.

As shown in FIGS. 1 and 6, two connecting hinges 51, 53, are provided along one of the longitudinal edges 55 of the secondary lid 37 for providing a hinged connection. Because the ice chest 11 is typically carried in the upright position illustrated in FIG. 5 of the drawings, the secondary lid 37 is typically formed of a relatively heavier duty construction than the primary lid. By "heavier duty construction" is meant that the lid may be thicker in dimension, more thoroughly insulated or insulated, with a higher quality type of insulation than the primary lid 31. Thus, with reference to FIGS. 3 and 4, the thickness "$d_2$" is greater than the thickness "$d_1$". The more robust construction of the secondary lid 37 might also be provided in other ways, for example by the choice of insulating material for the lid body or the particular construction style of the lid body.

Each of the primary and secondary lids 31, 37 has an associated circumferential seal region (shown as 57 in FIG. 1) which forms sealing contact between the respective lid and the respective opening of the ice chest body when the respective lid is moved to the closed position. The seal region can comprise a seal ring in a groove, such as O-ring seals 58 and 60 in FIGS. 3 and 4, and can be formed, for example, from a suitable elastomer such as a suitable or natural synthetic rubber. Once again, because the primary lid 31 will not typically be bearing the weight of the chest contents during transport, the circumferential seal ring 58 can typically be of less robust construction than the secondary lid seal ring 60. The circumferential seal region 57 can also assume other forms than that of a seal ring in a groove. For example, the seal region 57 might be formed in the lid body as a part of the plastic extrusion or injection molding process and constitute an integral part of the lid. It is only necessary that the seal region 57 form a mating seal with the ice chest body to retain cooling and prevent leaking.

Figure 5:
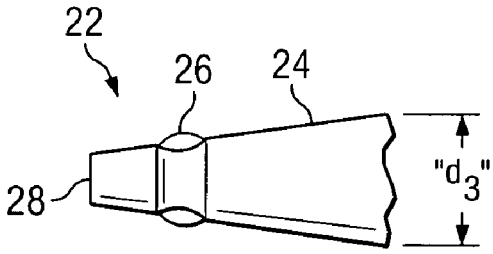
FIG. 5 is a partial sectional view of another embodiment of either the primary or secondary lid of the ice chest, showing the slope of the lid interior surface.

FIG. 5 shows another embodiment of the invention in which either or both of the primary and secondary lids is formed with a sloping interior surface 24. By making the lid cross-sectional thickness "$d_3$" decrease on the drain side, less liquid will be retained in the chest interior upon opening the fitting and draining the chest contents. In FIG. 5, the sloping lid 22 is provided with a drain fitting 26 adjacent the outer lid edge 28.

In order that the user of the chest be able to determine the proper orientation for transport, some sort of marking indicia (59 in FIG. 3) is provided on the chest exterior which indicates the correct orientation of the primary and secondary lids 31, 37. In the example shown, the mouths of the fish in the pattern are oriented upwardly.

In use, an ice chest is provided as previously described. The ice chest is first flipped upside down from the carrying position shown if FIG. 5. The interior 17 of the chest is partly filled with ice or another cooling medium. The item or items to be cooled are then placed on top of the level of the ice within the chest interior. The primary lid 31 is then closed and latched using the latch components 33, 35. The orientation of the ice chest body 13 would then be reversed or "flipped" so that the primary lid 31 which was previously oriented downward is now oriented upward. The reversible of the chest contents causes the ice in the chest interior to now cover thoroughly the items to be cooled. The ice chest can then be transported in the carrying position shown in FIG. 5. A user can access the item or items by opening the primary lid 37 which is oriented upwardly.

At some point, it may be necessary to add additional ice or items to the chest. The additional items can be added to the interior of the chest in the previous orientation. The orientation of the chest would then again be reversed so that the new items are covered with ice. The items can then be accessed through the opposite lid of the ice chest in the manner exactly reversed of that previously described.

An invention has been provided with several advantages. The ice chest of the invention is relatively simple in design and economical to manufacture without requiring drastic changes from traditional manufacturing techniques. Although the ice chest of the invention does involve the addition of an extra hinged lid, one of the lid, seal and latch structures can be formed of less robust construction than the other since the ice chest will typically always be transported in one particular orientation. Because the "top" lid does not bear the weight of the ice and chest contents, it can be formed of a less robust construction. The real structure of the primary lid can also be of less robust construction. External marking indicia on the chest indicates the correct orientation to the user for transport.

While the invention has been shown in only one of its forms, it is not thus limited but is susceptible to various changes and modifications without departing from the spirit thereof.

I claim:

1. A reversible ice chest, comprising:

a thermally insulated body having an exterior and an initially open interior which defines a top opening and a bottom opening for the body;

a primary lid which is movable between an open and a closed position with respect to a selected one of the top and bottom openings;

a latch for holding the primary lid in the closed position;

a secondary lid which is movable between an open position and a closed position with respect to the other respective one of the top and bottom openings;

an additional latch for holding the secondary lid in the closed position;

a pair of oppositely arranged carrying handles located on the exterior of the body, each carrying handle being slidably positionable between either of two carrying positions, depending upon whether the primary or the secondary lid is oriented in an upright position;

wherein the ice chest exterior is polygonally shaped being comprised of two pairs of opposing sides, and wherein a carrying handle is located on either of two of a selected pair of opposing sides of the ice chest; and wherein each handle is comprised of a longitudinal bracket and a clasp which is free to slide upwardly and downwardly within the bracket.

2. The reversible ice chest of claim 1, wherein the primary and secondary lids are hingedly connected to the ice chest body proximate the top and bottom openings, respectively, thereof.

3. The reversible ice chest of claim 2, wherein the secondary lid is formed of a relatively heavier duty construction than the primary lid.

4. The reversible ice chest of claim 2, wherein each of the primary and secondary lids has an associated circumferential seal region which forms sealing contact between the lid and the ice chest body when the respective lid is moved to the closed position.

5. The reversible ice chest of claim 4, wherein the secondary lid seal region is of more robust construction than the primary lid seal region.

6. The reversible ice chest of claim 2, wherein the secondary lid has a relative thickness which is greater than that of the primary lid.

7. The reversible ice chest of claim 1, wherein the exterior of the ice chest is provided with marking indicia which indicates the current orientation of the primary and secondary lids.

8. The reversible ice chest of claim 4, wherein the chest has a pair of vertically spaced chain fittings so that one fitting is always conveniently located for draining the chest.

9. The reversible ice chest of claim 4, wherein each of the primary and secondary lids has a sloping cross-sectional thickness to facilitate draining contents of the chest.

10. A method of cooling items, the method comprising the steps of:

providing an ice chest having:

a thermally insulated body having an exterior and an initially open interior which defines a top opening and a bottom opening for the body;

a primary lid which is movable between an open and a closed position with respect to a selected one of the top and bottom openings;

a latch for holding the primary lid in the closed position;

a secondary lid which is movable between an open position and a closed position with respect to the other respective one of the top and bottom openings;

an additional latch for holding the secondary lid in the closed position;

a pair of oppositely arranged carrying handles located on the exterior of the body, each carrying handle being slidably positionable between either of two carrying positions, depending upon whether the primary or the secondary lid is oriented in an upright position;

partially filling the interior of the ice chest body with ice;

placing the items to be cooled on top of the ice in the interior of the chest;

reversing the orientation of the ice chest body so that the lid which was previously oriented upward is now oriented downward and the ice in the chest interior is now covering the items to be cooled;

accessing an item by opening the now upwardly oriented lid.

11. The method of claim 10, further comprising the steps of:

adding additional items to be cooled to the interior of the ice chest; and reversing the orientation of the ice chest so that the new items are covered with ice;

accessing the items through the opposite lid of the ice chest.

* * * * *